US006137822A

United States Patent [19]

Hake et al.

[11] Patent Number: 6,137,822

[45] Date of Patent: Oct. 24, 2000

[54] DIRECT CURRENT ARC FURNACE AND A METHOD FOR MELTING OR HEATING RAW MATERIAL OR MOLTEN MATERIAL

[75] Inventors: Joseph L. Hake, New Castle; Richard L. Cook, Pittsburgh, both of Pa.

[73] Assignee: NKK Steel Engineering, Inc., Mars, Pa.

[21] Appl. No.: 09/032,442

[22] Filed: Feb. 27, 1998

[51] Int. Cl.[7] ..... F27D 1/00

[52] U.S. Cl. ..... 373/72; 373/88

[58] Field of Search ..... 373/72, 74, 76, 373/88

[56] References Cited

U.S. PATENT DOCUMENTS

| | | | |
|---|---|---|---|
| 4,435,812 | 3/1984 | Guido et al. | 373/72 |
| 4,615,035 | 9/1986 | Biihler | 373/72 |
| 4,730,337 | 3/1988 | Schubert | 373/72 |
| 4,947,405 | 8/1990 | Okada | 373/72 |
| 5,142,650 | 8/1992 | Kida et al. | 373/88 |
| 5,177,763 | 1/1993 | Takashiba et al. | 373/72 |
| 5,268,924 | 12/1993 | Sakakibara et al. | 373/72 |
| 5,479,433 | 12/1995 | Maki et al. | 373/72 |

*Primary Examiner*—Teresa Walberg
*Assistant Examiner*—Quang Van
*Attorney, Agent, or Firm*—Ansel M. Schwartz

[57] ABSTRACT

A direct current electric arc furnace for melting or heating raw material or molten material includes a refractory lined vessel for holding raw or molten material in its interior. The furnace includes at least a first top electrode. The first top electrode enters the vessel interior above the raw or molten material. The furnace includes at least a first bottom electrode mounted in the bottom of the vessel and in electrical contact with the raw or molten material in the vessel. The furnace includes an electrical power supply mechanism which electrically connects to the top electrode and the bottom electrode in order to input electrical energy into the material through the top and bottom electrodes in the form of an arc. The bottom electrode has opposite electrical polarity to the electrical polarity of the top electrode. The furnace also includes a mechanism for cooling the first bottom electrode with a spray of water and air that contacts the first bottom electrode. A method for operating a direct current arc furnace.

11 Claims, 9 Drawing Sheets

DIRECT CURRENT ARC FURNACE AND A METHOD FOR MELTING OR HEATING RAW MATERIAL OR MOLTEN MATERIAL

This invention is related to U.S. patent applications Ser. Nos. 08/806,848, 08/806,204 and 08/807,803, all of which are incorporated by reference herein.

FIELD OF THE INVENTION

The present invention is related to a direct current arc furnace. More specifically, the present invention is related to a direct current arc furnace having a cooling mechanism which provides a spray of air and water to the bottom electrode to cool the bottom electrode.

BACKGROUND OF THE INVENTION

Previous large DC arc furnaces cool the bottom electrode by means of air being forced into the bottom electrode to remove the heat generated by the molten steel. The bottom electrode life can be increased if the bottom electrode can be cooled sufficiently. By removing the heat from the bottom electrode, the depth of the steel which remains molten within the refractory decreases. By decreasing the depth which the steel is molten within the refractory decreases the erosion of the refractory thereby extending the life of the bottom electrode. The present invention cools the bottom electrode with a spray of air and water and has an upper base plate that distributes the current to top rod portions which are offset from bottom rod portions.

SUMMARY OF THE INVENTION

The present invention pertains to a direct current electric arc furnace for melting or heating raw material or molten material. The furnace comprises a refractory lined vessel for holding raw or molten material in its interior. The furnace comprises at least a first top electrode. The first top electrode enters the vessel interior above the raw or molten material. The furnace comprises at least a first bottom electrode mounted in the bottom of the vessel and in electrical contact with the raw or molten material in the vessel. The furnace comprises an electrical power supply mechanism which electrically connects to the top electrode and the bottom electrode in order to input electrical energy into the material through the top and bottom electrodes in the form of an arc. The bottom electrode has opposite electrical polarity to the electrical polarity of the top electrode. The furnace also comprises a mechanism for cooling the first bottom electrode with a spray of water and air that contacts the first bottom electrode.

The present invention pertains to a method for operating a direct current arc furnace. The method comprises the steps of guiding direct current from an electrical power supply mechanism to a bottom electrode connected to a refractory lined vessel through an electrical conductor connected to the bottom electrode and the power supply mechanism. Next there is the step of melting metal in the vessel with an arc that is formed from a first top electrode which has direct current provided to it and the bottom electrode. The first top electrode has an electrical polarity opposite of the electrical polarity of the bottom electrode. Then there is the step of cooling the bottom electrode with a spray of air and water that contacts the bottom electrode.

BRIEF DESCRIPTION OF THE DRAWINGS

In the accompanying drawings, the preferred embodiment of the invention and preferred methods of practicing the invention are illustrated in which.

DESCRIPTION OF THE PREFERRED EMBODIMENT

Figure 1:
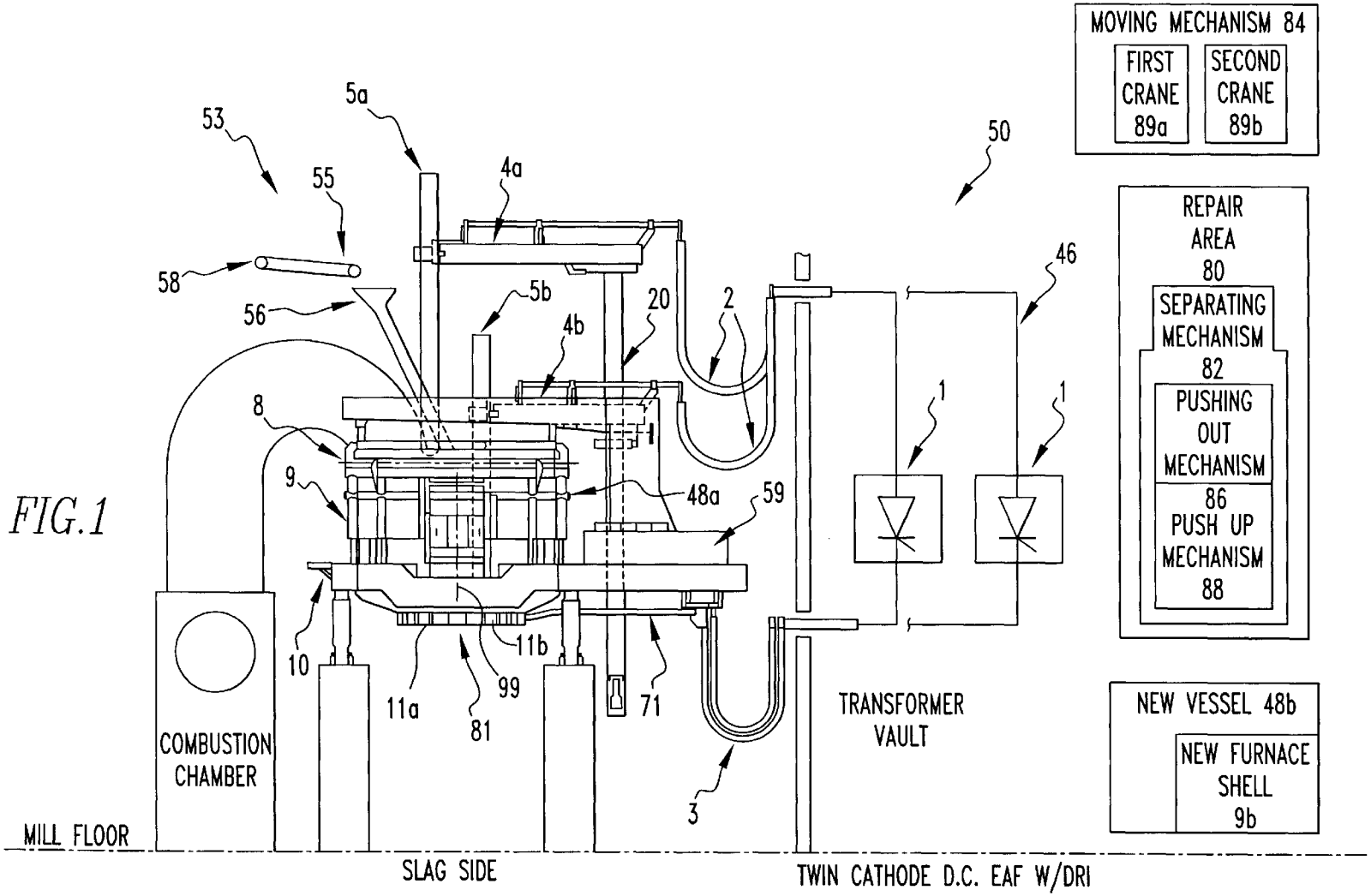
FIG. 1 is a schematic representation of a furnace of the present invention.
Figure 2:
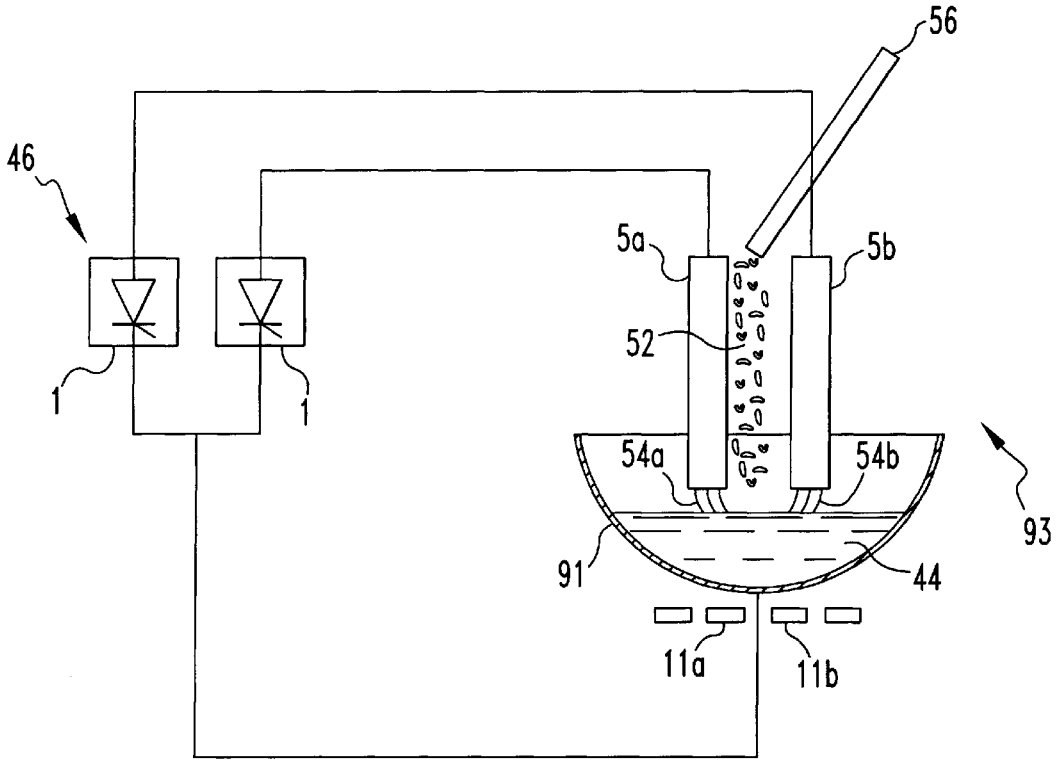
FIG. 2 is a schematic representation of a portion of the furnace.
Figure 6:
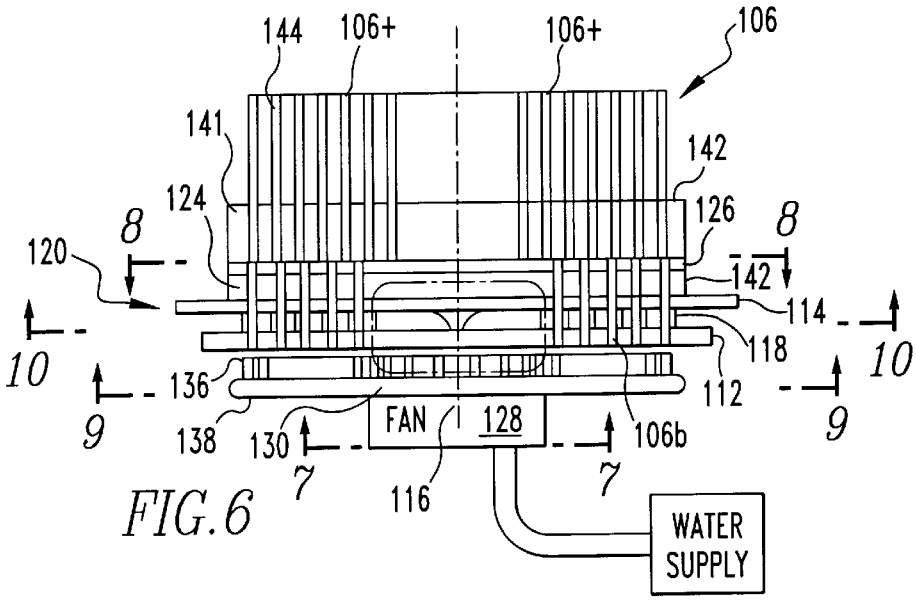
FIG. 6 is a schematic representation of a side view of a bottom electrode and cooling mechanism.

Referring now to the drawings wherein like reference numerals refer to similar or identical parts throughout the several views, and more specifically to FIGS. 1, 2 and 6 thereof, there is shown a direct current electric arc furnace 50 for melting or heating raw material 44 or molten material 44. The furnace 50 comprises a refractory lined vessel 48 for holding raw or molten material 44 in its interior. The furnace 50 comprises at least a first top electrode 5*a*. The first top electrode 5*a* enters the vessel 48 interior above the raw or molten material 44. The furnace 50 comprises at least a first bottom electrode 11*a* mounted in the bottom of the vessel 48 and in electrical contact with the raw or molten material 44 in the vessel 48. The furnace 50 comprises an electrical power supply mechanism 46 which electrically connects to the top electrode 5*a* and the bottom electrode 11*a* in order to input electrical energy into the material 44 through the top and bottom electrodes in the form of an arc 54. The bottom electrode 11*a* has opposite electrical polarity to the electrical polarity of the top electrode 5*a*. The furnace 50 also comprises a mechanism 102 for cooling the first bottom electrode 11*a* with a spray of water and air that contacts the first bottom electrode 11*a*.

Preferably, the bottom electrode 11*a* comprises a terminal 104 and rods 106 which extend from the terminal 104 to the vessel 48, as shown in FIGS. 6–11*a,* 11*b,* 11*c* and 11*d*. Preferably, the cooling mechanism 102 includes a cooling space 118 through which the rods 106 extend and in which the spray of air and water circulates and contacts the rods 106 to cool them. The cooling mechanism 102 preferably includes piping 110 that contacts the first bottom electrode 11*a*. The piping 110 has water flowing through it.

The cooling mechanism 102 preferably includes a bottom plate 112 contacting the terminal 104 and the rods 106. The cooling mechanism 102 preferably includes a base plate 114 in spaced relation and in parallel with the bottom plate 112 and contacting the rods 106. The cooling space 118 is disposed between the base plate 114 and the bottom plate 112.

The bottom plate 112 preferably has a central axis 116 and a cooling space 118 about the central axis 116. The cooling mechanism 102 preferably has a plurality of spiral plates 120 disposed in the cooling space 118 and extending from the central axis 116 for defining flow paths 122 for the spray to follow and cool the rods 106.

The cooling mechanism 102 preferably includes a thermal insulation layer 124 disposed on the base plate 114. Preferably, the cooling mechanism 102 includes an upper base plate 126 disposed on the thermal insulation layer 124 and which contacts the vessel 48. The thermal insulation layer 124 is preferably made of a refractory material. The rods are preferably comprised of bottom rod portions 106*b* connected to the upper base plate, and top rod portions 106*t* connected to the upper base plate and offset from the bottom rod portions 106*b*.

The cooling mechanism 102 preferably includes a fan 128 for blowing air. The cooling mechanism 102 preferably also includes a duct 130 connected with the fan 128 and the cooling space 118 for blowing air from the fan 128 to the cooling space 118. Preferably, the cooling mechanism 102 includes a water supply 132, and a hose 134 connected to the water supply 132 and the cooling space 118 for flowing water into the cooling space 118.

The piping 110 preferably includes a water cooled channel 136 connected to the bottom plate 112, and a water header 138 connected to the terminals 104.

The present invention pertains to a method for operating a direct current arc furnace 50. The method comprises the steps of guiding direct current from an electrical power supply mechanism 46 to a bottom electrode 11*a* connected to a refractory lined vessel 48 through an electrical conductor 71 connected to the bottom electrode 11*a* and the power supply mechanism 46. Next there is the step of melting metal 44 in the vessel 48 with an arc 54 that is formed from a first top electrode 5*a* which has direct current provided to it and the bottom electrode 11*a*. The first top electrode 5*a* has an electrical polarity opposite of the electrical polarity of the bottom electrode 11*a*. Then there is the step of cooling the bottom electrode 11*a* with a spray of air and water that contacts the bottom electrode 11*a*.

The cooling step preferably includes the step of running water through piping 110 that contacts the bottom electrode 11*a*. Preferably, the cooling step includes the step of cooling the bottom electrode 11*a* with a continuous spray of air and water. Preferably, the cooling step includes the step of spraying air and water on rods 106 of the bottom electrode 11*a* through flow paths 122 defined by spiral plates 120 in a cooling space 118 in the bottom electrode 11*a*.

Figure 3:
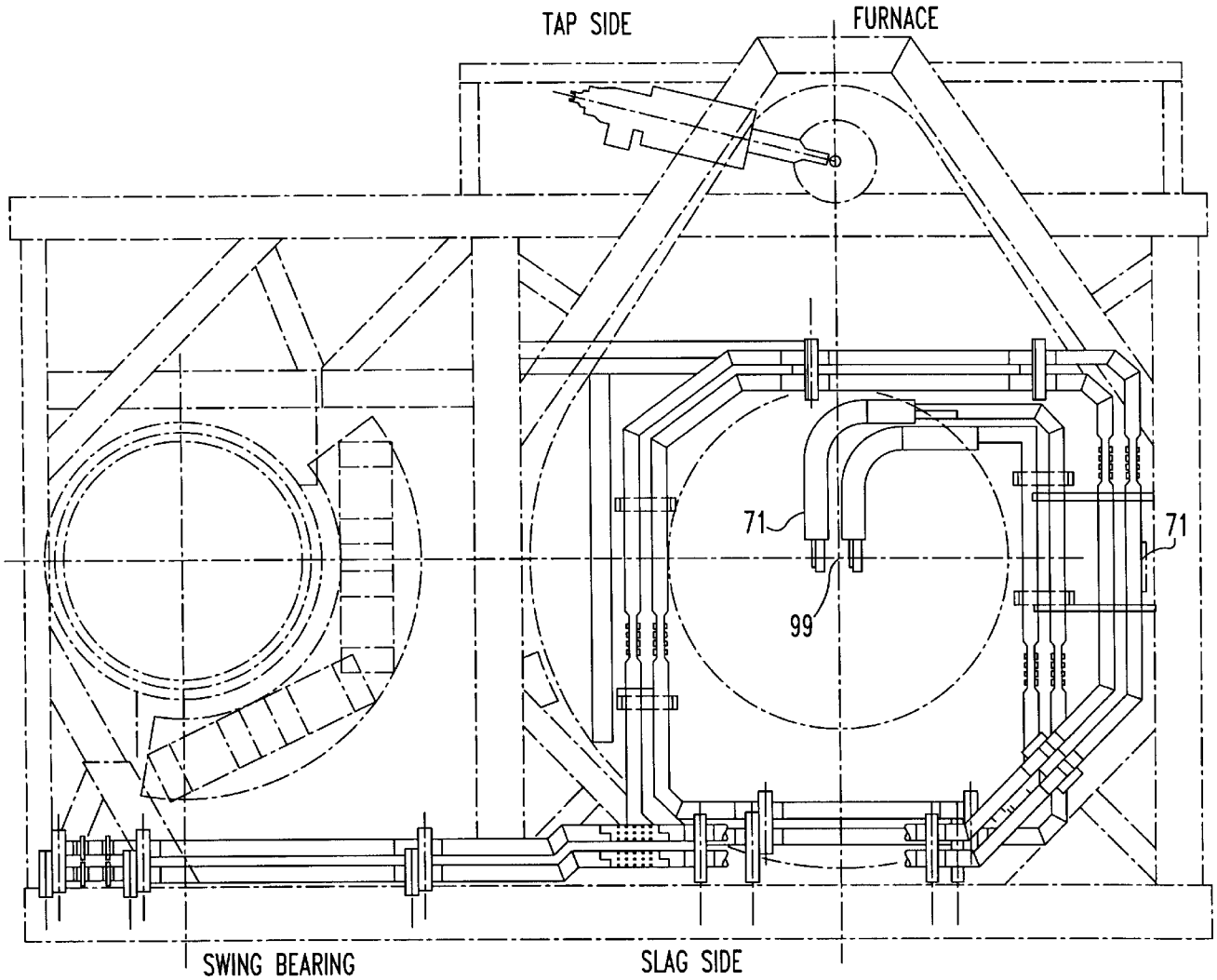
FIG. 3 is a schematic representation of an overhead view of an electrical conductor of the present furnace.

In the operation of the preferred embodiment and referring to FIGS. 1–3, the DC arc furnace comprises a refractory lined furnace shell 9 to contain the material to be melted, a furnace cover 8 to contain the heat energy in the furnace shell, one or more top electrodes 5, typically of graphite, protruding through the furnace cover 8 and capable of moving vertically in order to establish and arc between the tip of the electrode and the material 44 to be melted, an electrode arm 4 for each top electrode to support the electrode, a movable mast 20 to raise and lower the electrode, one or more bottom electrodes 11 located in the bottom of the furnace shell 9, one or more DC power supplies 1 to provide the necessary electrical energy to the furnace for melting, the necessary anode and cathode water cooled cables 2 and 3 to conduct the electrical energy from the power supplies to the furnace, typically the anode connections 3 go to the bottom electrode 11 and the cathode connections 2 to the top electrode 5. There is a tilt platform 10 which supports the furnace vessel 48, the superstructure 59, the electrode arms 4*a* and 4*b* and the electrodes 5*a* and 5*b* and provides for the capability to tilt the furnaces for tapping purposes and slagging off purposes.

Figure 4:
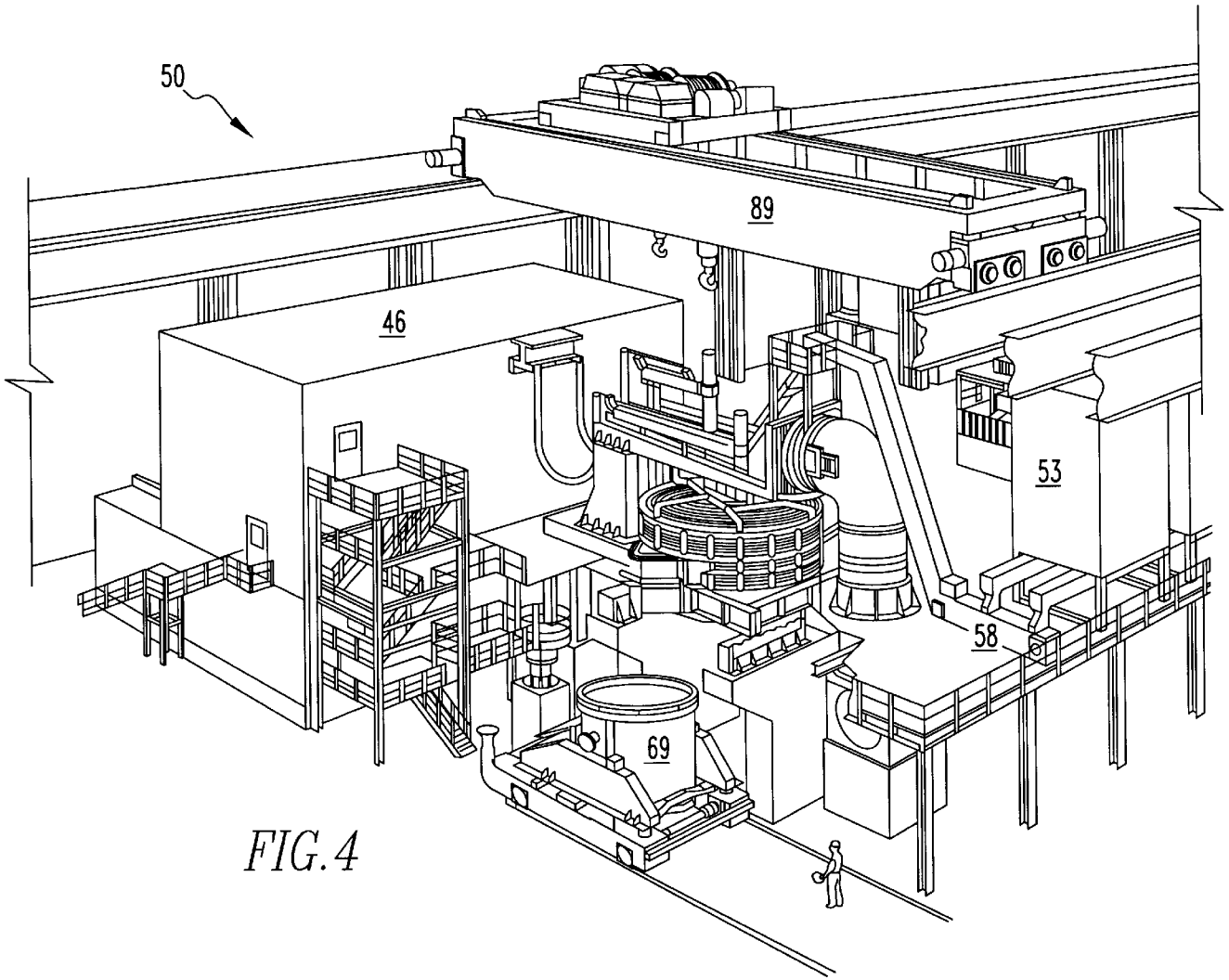
FIG. 4 is a schematic representation of the perspective view of the furnace.

A typical operation sequence consists of removing the furnace cover 8 from the furnace shell 9 of the vessel 48, placing the charge material 44 (typically scrap iron and/or steel) in the furnace shell 9, putting the furnace cover 8 back on the furnace shell 9, energizing the DC furnace power supply 1 (which include, for instance, rectifiers of the power supply mechanism 46), and lowering the top electrode 5 to establish an arc 54 between the charge material which is electrically in contact with the bottom electrode 11 and the tip of the top electrode 5. This arcing continues until the charge material is melted. At this time, if additional molten material 44 is required, the above sequence will be repeated one or more times, or it might be desirable to continuously feed unmelted iron substitutes such as pre-reduced iron pellets into the molten charge material at a rate which corresponds to the capability of the furnace to melt it. This will continue until such time that the required total amount of molten material in the furnace is reached. At that point in time, the furnace is tapped (the molten material is poured into another vessel 69, see FIG. 4) for further processing.

A DC arc furnace comprises a refractory lined vessel to contain the material 44 to be melted and/or heated. There is a furnace cover 8 to contain the energy in the vessel during the process. There are one or more top electrodes protruding through the furnace cover 8 and movable vertically to obtain the desired distance between the bottom tip of the electrode(s) and the material 44 to be melted (heated). There are one or more removable or fixed bottom electrode(s) 11 located in the refractory lining of the bottom of the furnace shell 9. There are one or more DC power supplies electrically connected to the top and bottom electrodes such that an arc(s) 54 can be established between the top electrode(s) and the material to be melted (heated).

Figure 5:
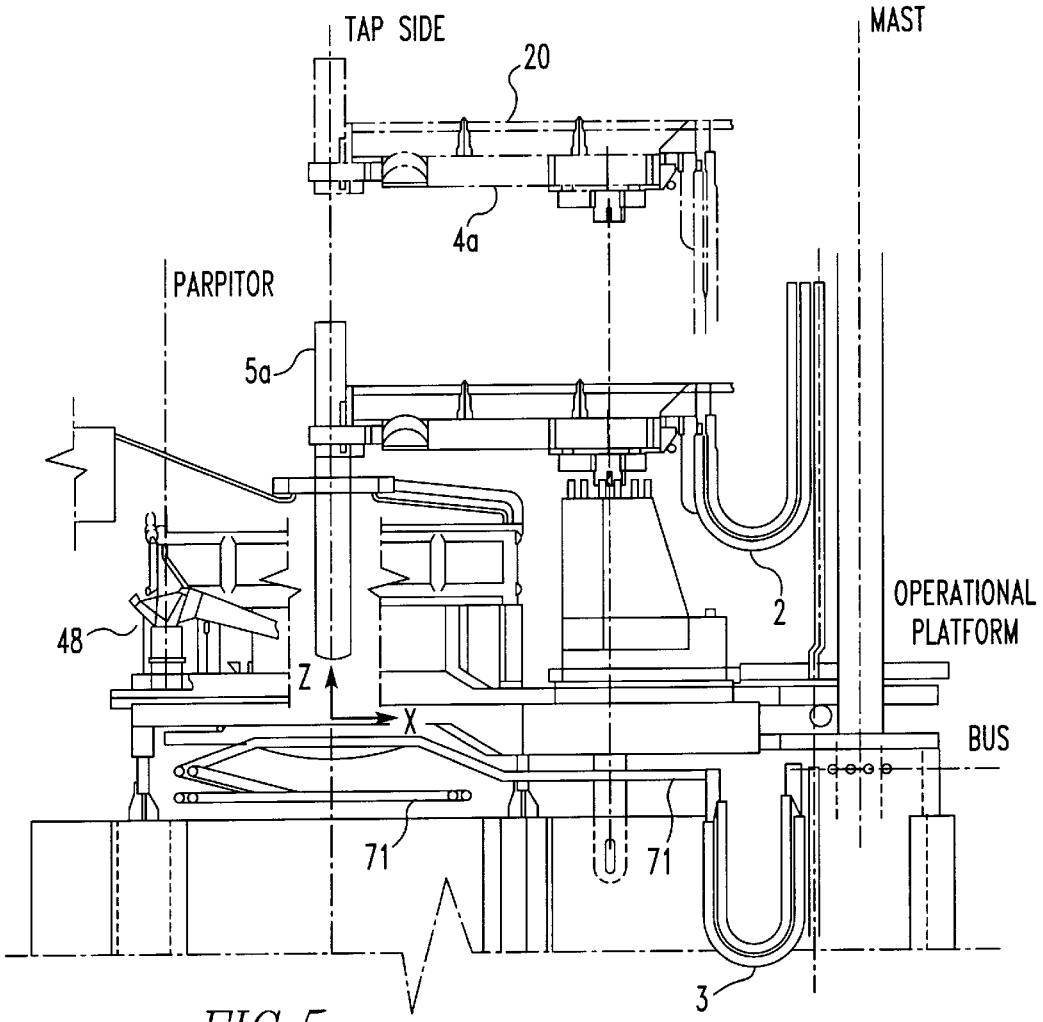
FIG. 5 is a schematic representation of a side view of the furnace.
Figure 8:
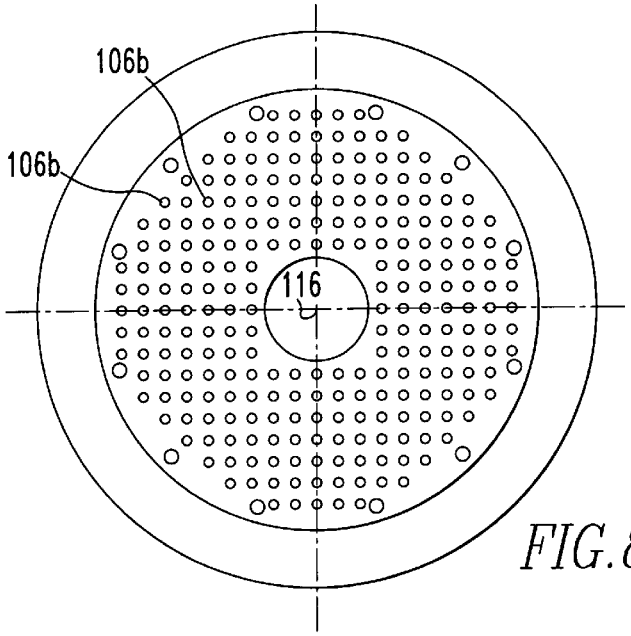
FIG. 8 is a schematic representation of Section 8 of FIG. 6.

As the current flows through the conductor 71 and follows the current path defined by the conductor 71, magnetic fields are created. The magnetic fields are defined by the current in the conductor 71 and the shape of the conductor 71. As shown in FIG. 3 and FIG. 5, from the bus, the conductor 71 loops about the center axis 99 of the vessel 48 and creates magnetic fields which are essentially all in the vertical direction or z direction and essentially not at all in the horizontal direction or X and Y directions. By the magnetic field present about the first top electrode 5*a* being essentially all in the vertical direction, the deflection of the arc is guided by the vertical magnetic fields to be essentially vertically oriented toward the metal 48 and the bottom of the vessel 48.

Figure 7:
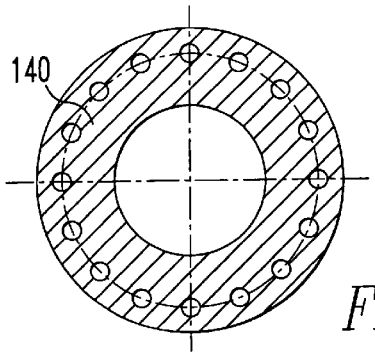
FIG. 7 is a schematic representation of Section 7 of FIG. 6.
Figure 10:
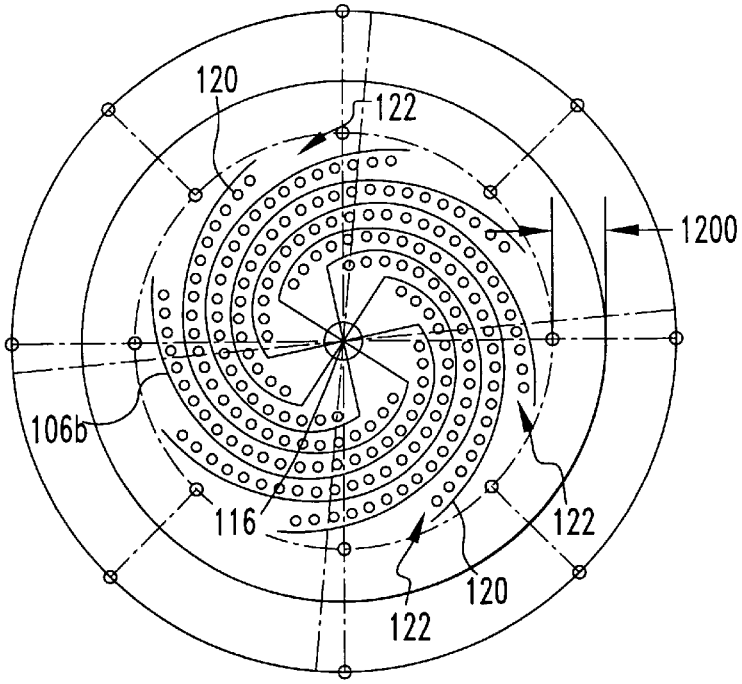
FIG. 10 is a schematic representation of Section 10 of FIG. 6.
Figure 9:
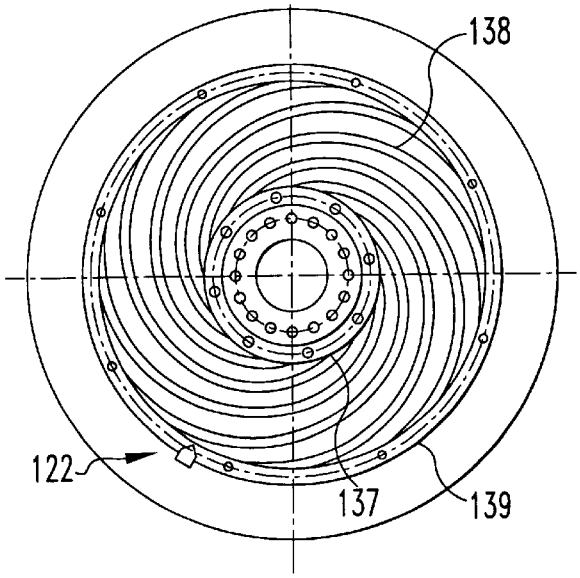
FIG. 9 is a schematic representation of Section 9 of FIG. 6.
Figure 11B:
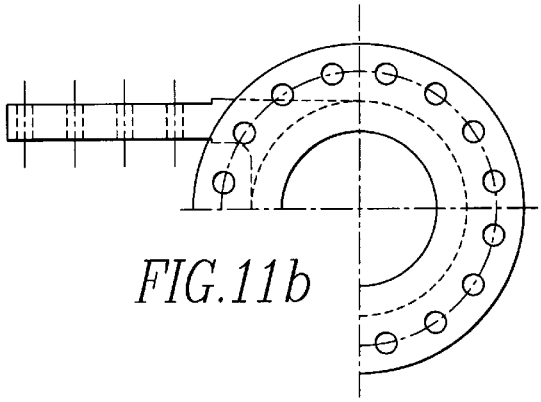
FIGS. 11*a,* 11*b,* 11*c* and 11*d* are schematic representations of the terminal and the vessel.
Figure 11C:
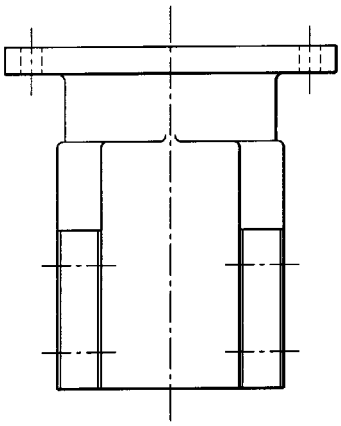
Figure 11A:
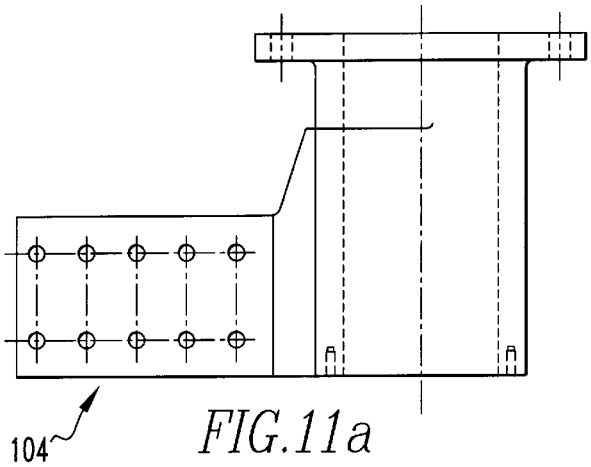
Figure 11D:
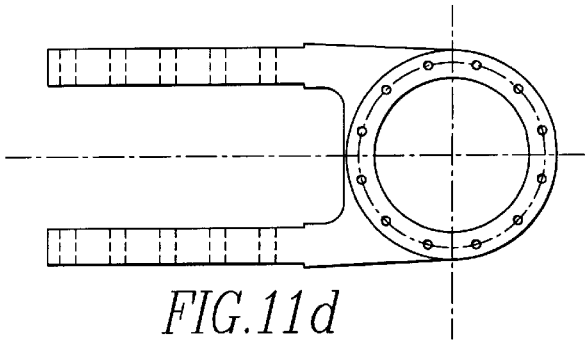

The conductor 71 connects to the interface plate 140 having silver plating through a copper terminal 104, as shown in FIG. 7. Current provided to the terminal is between 50 KA and 350 KA depending on furnace size. About the interface plate 140 is a water header 138 for cooling of the interface plate 140 and bottom electrode 11*a* in general, as shown in FIGS. 6 and 10. The water header 138 has a supply header 137 to receive water and a return header 139 to remove water therefrom, as shown in FIG. 10. Above the water header 138 and interface plate 140 is a water cooled channel 136 to add further cooling to the bottom electrode 11*a* generally and the bottom plate 112 specifically. The bottom plate 112, besides being in contact with the water cooled channel 136 for cooling purposes is also connected to the interface plate 140 and the bottom rod portions 106*b*. The bottom plate 112 made of copper serves to distribute the current received from the interface plate 140 to the bottom rod portions 106*b* so the current is distributed essentially evenly throughout the bottom rod portions 106*b* and there is no one area that receives a greater amount of current which could cause overheating or other types of failures in such an area.

Figure 12:
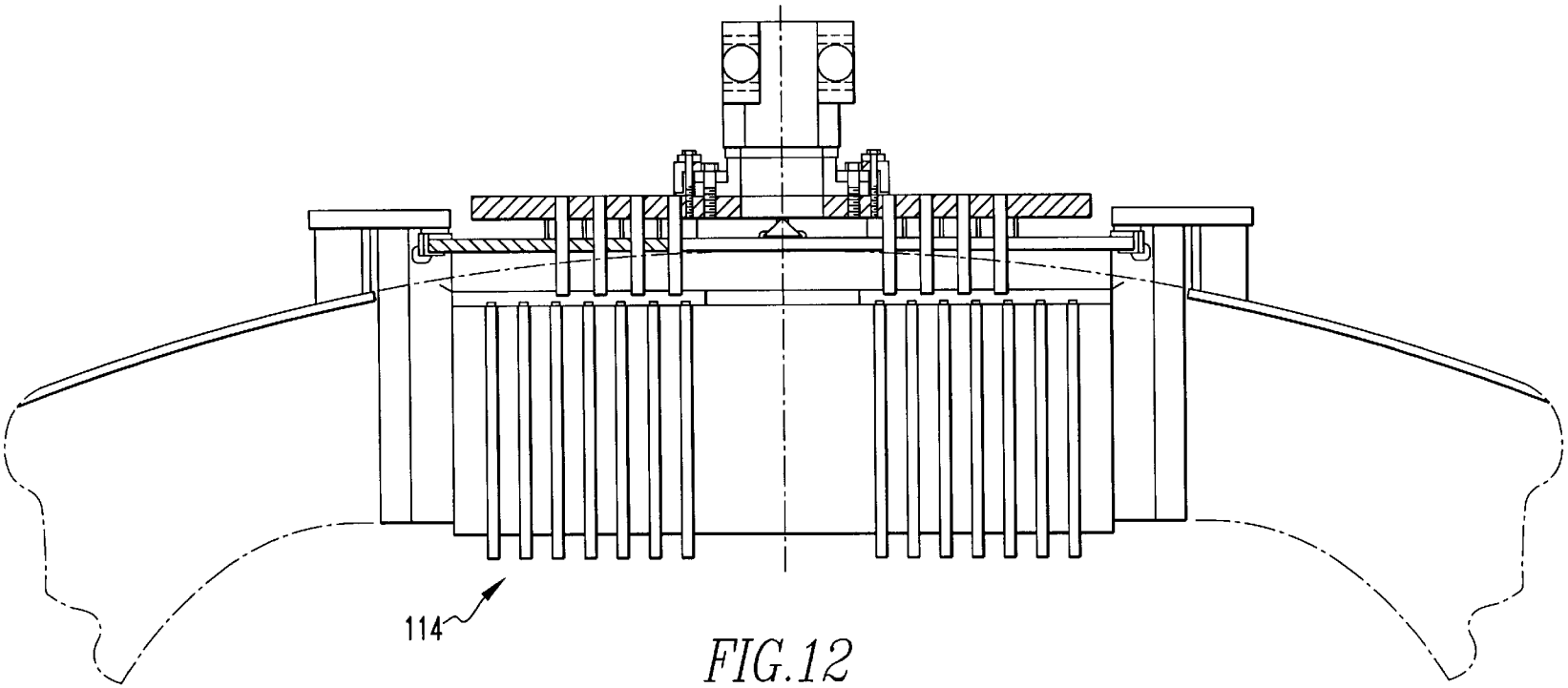
FIG. 12 is a schematic representation of the base plate and the vessel.

Spaced apart from the bottom plate 112 is a base plate 114 disposed above the bottom plate 112 and separated from the bottom plate 112 by a plurality of spiral plates 120, as shown in FIG. 10. The base plate 114 connects to and interfaces with the ring of the vessel 48 structure when it is in place, as shown in FIG. 12, as is well known in the art. The spiral plates 120 extend essentially from the center axis 116 of the furnace 50 and curve continually outwards therefrom. The spiral plates 120 together define flow paths 122 for coolant spray of air and water to follow to cool the bottom rod portions 106*b* and bottom electrode 11*a* generally. The spray is provided to the flow paths 122 through a duct 130 that connects to the furnace 50 about the center axis 116 through the interface plate 140 and bottom plate 112 and through a hose 134 delivering water also connected to the furnace 50 about the center axis 116 through the interface plate 140 and bottom plate 112. The duct 130 provides a path for air blown by a fan 128 to flow through the flow paths 122 and to join with the water from the hose 134 to create a spray. The distance between the bottom plate 112 and the base plate 114 is 5 inches. The dimensions of the bottom plate 112 are 106" diameter×3.25" thick. The dimensions of the base plate 114 are 118" diameter×2" thick. The dimensions of the spiral plates 120 are 50"×5"×122". The dimensions of the silver plated area for the terminal are 64" OD×32" ID. The base plate 114 is made of copper. The bottom electrode could include water only on the bottom cooling plate or air and then water on the bottom plate for an added layer of safety in the event of an electrical failure of the air blower or water supply.

On the base plate 114 is disposed a thermal insulation layer 124 made of a refractory material. There is a rolled plate 142 that defines the circumference of the refractory material and which acts as a mold in which the refractory material is formed. The bottom rod portions 106*b* extend from the bottom plate 112 through the cooling space 118, through the base plate 114 through the thermal insulation layer 124 to an upper base plate 126. The thermal insulation layer 124 serves to provide additional protection against the heat from the molten metal 44 to protect and increase the longevity of the base plate 114 and bottom plate 112.

On the thermal insulation layer 124 is an upper base plate 126 that connects with the bottom rod portions 106*b* extending from the bottom plate 112. See FIG. 8. Unlike previous designs in which the conductive medium extends from the electrical connections of the bottom electrode through the refractory to the molten steel, the furnace 50 utilizes an upper base plate 126. It is possible for only a small portion of the conductive media to be in contact with the steel which is to be melted in the furnace. This condition would cause a large amount of current to flow through a small cross section of the conductive media. This may cause the media to melt at a very quick rate. If this happens, the thermocouples which are used to monitor the bottom would fail to react quick enough especially if they are not located at the exact area of the high current concentration. By employing an upper base plate 126, this high concentration of current would be distributed within the upper base plate 126 and then to the electrical connection causing the plate to heat up at a much slower rate and retaining the molten steel to an area above the additional refractory layer thus preventing the likelihood of a leak outside of the bottom electrode. The upper base plate 126 serves to distribute the current evenly from the bottom rod portions 106*b*extending from the bottom plate 112 to the top rod portions 106*t*, much like the bottom plate 112 distributes the current from the terminal 104 to the bottom rod portions 106*b* connected to it. The upper base plate 126 is also connected to top rod portions 106*t* that extend up from it into the vessel 48 itself to heat the metal 44 or material 44 therein. The current travels from the terminal 104, through the interface plate 140, through the bottom rod portions 106*b*, through the base plate 114 and through the top rod portions 106*t* which heat them and thus the metal 44 in the vessel 42. The top rod portions 106*t* connected to the upper base plate 126 are offset in alignment from the bottom rod portions 106*b*. By being offset, no continuous physical path is provided for molten metal 44 to escape through in the event there is some form of failure or breakdown in the bottom electrode 11*a*. The upper base plate 126 further serves to act as a stop to the molten metal 44 in the event it burns through a top rod portion 106*t*. This concept of the top rod portions 106*t* offset with the bottom rod portions 106*b* and a copper base plate 114 therebetween further adds to the safety of the furnace 50.

Disposed above the upper base plate 114 is an additional refractory layer 141 which has a rolled plate 142 about its circumference which acts as a mold in which the refractory material above the upper base plate 126 is formed. The bricks 144 of the furnace 50 are disposed above the refractory layer 141 above the upper base plate 126. The top rod portions 106*t* extend through the refractory layer above the upper base plate 126 and the brick 144. The bricks 144 serve to provide further protection and insulation from the molten metal 44 in the furnace 50. The dimensions of the thermal insulation layer 124 are 96" diameter×6.50" thick. The dimensions of the upper base plate 126 are 96" diameter×2" thick. The upper base plate 126 is made of steel. The refractory layer disposed above the upper base plate 126 has the dimensions of 96" diameter×36" deep. The dimensions of the rolled plate 142 are 12"×12"×302". The dimensions of the brick layer of the vessel 48 are 14" thick side wall×39" thick bottom. It should be noted that all dimensions are for exemplary purposes, but they will differ in a case by case basis.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A direct current electric arc furnace for melting or heating raw material or molten material comprising:

a refractory lined vessel for holding raw or molten material in its interior;

at least a first top electrode, said first top electrode entering the vessel interior above the raw or molten material;

at least a first bottom electrode mounted in the bottom of the vessel and in electrical contact with the raw or molten material in the vessel, said bottom electrode comprises a terminal and rods which extend from the terminal to the vessel;

an electrical power supply mechanism which electrically connects to the top electrode and the bottom electrode in order to input electrical energy into the material through the top and bottom electrodes in the form of an arc, said bottom electrode having opposite electrical polarity to the electrical polarity of the top electrode; and a mechanism for cooling the first bottom electrode with a spray of water and air that contacts the first bottom electrode, said cooling mechanism includes piping that contacts the first bottom electrode, said piping has water flowing through it, said cooling mechanism includes an air space through which the rods extend and in which the spray of air and water circulates and contacts the rods to cool them, said cooling mechanism includes a bottom plate contacting the terminal and the rods, and a base plate in spaced relation and in parallel with the bottom plate and contacting the rods, said air space disposed between the base plate and the bottom plate, the cooling mechanism includes a fan for blowing air a duct connected with the fan and the air space for blowing air from the fan to the air space, a water supply, and a hose connected to the water supply and the air space for flowing water into the air space.

2. A furnace as described in claim 1 wherein the bottom plate has a central axis and a cooling space about the central axis, and wherein the cooling mechanism has a plurality of spiral plates disposed in the air space and extending from the central axis for defining flow paths for the spray to follow and cool the rods.

3. A furnace as described in claim 2 wherein the cooling mechanism includes a thermal insulation layer disposed on the base plate.

4. A furnace as described claim 3 wherein the cooling mechanism includes an upper base plate disposed on the thermal insulation layer and which contacts the vessel.

5. A furnace as described in claim 4 wherein the thermal insulation layer is made of a refractory material.

6. A furnace as described in claim 5 wherein the piping includes a water cooled channel connected to the bottom plate, and a water header connected to the terminals.

7. A furnace as described in claim 6 wherein the rods comprise bottom rod portions connected to the upper base plate, and upper rod portions connected to the upper base plate and offset from the bottom rod portions.

8. A method for operating a direct current arc furnace comprising the steps of:

guiding direct current from an electrical power supply mechanism to a bottom electrode connected to a refractory lined vessel through an electrical conductor connected to the bottom electrode and the power supply mechanism;

melting metal in the vessel with an arc that is formed from a first top electrode which has direct current provided to it and the bottom electrode, said first top electrode having an electrical polarity opposite of the electrical polarity of the bottom electrode; and cooling the bottom electrode with a spray of air from a fan and water from a hose that contacts the bottom electrode and with a spray of air from the fan and water from the hose on rods of the bottom electrode through flow paths defined by spiral plates in an air space in the bottom electrode.

9. A method as described in claim 8 wherein the cooling step includes the step of running water through piping that contacts the bottom electrode.

10. A method as described in claim 9 wherein the cooling step includes the step of cooling the bottom electrode with a continuous spray of air and water.

11. A direct current electric arc furnace for melting or heating raw material or molten material comprising:

a refractory lined vessel for holding raw or molten material in its interior;

at least a first top electrode, said first top electrode entering the vessel interior above the raw or molten material;

at least a first bottom electrode mounted in the bottom of the vessel and in electrical contact with the raw or molten material in the vessel, said bottom electrode comprising a terminal and rods which extend from the terminal to the vessel, said rods having top rod portions and bottom rod portions;

an electrical power supply mechanism which electrically connects to the top electrode and the bottom electrode in order to input electrical energy into the material through the top and bottom electrodes in the form of an arc, said bottom electrode having opposite electrical polarity to the electrical polarity of the top electrode; and a mechanism for cooling the first bottom electrode that contacts the first bottom electrode, said cooling mechanism having an upper base plate disposed between the top rod portions and bottom rod portions, said top rod portions offset in alignment from said bottom rod portions.

* * * * *